US008668324B2

(12) United States Patent
Ikoshi

(10) Patent No.: US 8,668,324 B2
(45) Date of Patent: Mar. 11, 2014

(54) IMAGE FORMING METHOD AND IMAGE FORMING APPARATUS

(75) Inventor: Masao Ikoshi, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 143 days.

(21) Appl. No.: 13/193,632

(22) Filed: Jul. 29, 2011

(65) Prior Publication Data

US 2012/0026264 A1 Feb. 2, 2012

(30) Foreign Application Priority Data

Jul. 30, 2010 (JP) ..... 2010-173066

(51) Int. Cl.
*B41J 2/01* (2006.01)

(52) U.S. Cl.
USPC ..... 347/102; 347/104

(58) Field of Classification Search
USPC ..... 101/424.2; 347/17, 72, 102, 104; 399/45, 99; 427/256; 428/425.1
See application file for complete search history.

(56) References Cited

U.S. PATENT DOCUMENTS

| | | | | |
|---|---|---|---|---|
| 4,332,198 | A * | 6/1982 | Schmoeger | 101/424.2 |
| 4,882,992 | A | 11/1989 | Schmoeger | |
| 5,489,567 | A * | 2/1996 | Koshizuka et al. | 503/227 |
| 2003/0156177 | A1* | 8/2003 | Nishikawa et al. | 347/102 |
| 2004/0058166 | A1* | 3/2004 | Nakamura | 428/425.1 |
| 2005/0131101 | A1 | 6/2005 | Takahashi | |
| 2005/0157097 | A1* | 7/2005 | Terakura | 347/72 |
| 2006/0120738 | A1* | 6/2006 | Bartley et al. | 399/45 |
| 2006/0221112 | A1* | 10/2006 | Ito | 347/17 |
| 2008/0058207 | A1* | 3/2008 | Ohga | 503/225 |
| 2009/0068360 | A1* | 3/2009 | Shimada et al. | 427/256 |
| 2009/0087211 | A1* | 4/2009 | Kadomatsu et al. | 399/99 |
| 2009/0244146 | A1 | 10/2009 | Chiwata | |
| 2009/0315926 | A1 | 12/2009 | Yamanobe | |

FOREIGN PATENT DOCUMENTS

| | | | |
|---|---|---|---|
| DE | 2605773 | A | 8/1997 |
| DE | 19859246 | A | 7/1999 |
| DE | 102008049547 | A | 4/2009 |
| EP | 2371573 | A | 10/2011 |
| JP | 10-128954 | | 5/1998 |
| JP | 2005-288883 | | 10/2005 |
| JP | 2006-028471 | | 2/2006 |
| JP | 2009-226886 | | 10/2009 |
| JP | 2010-005815 | | 1/2010 |
| JP | 2010-006560 | | 1/2010 |
| JP | 2006-231565 | A | 7/2010 |

OTHER PUBLICATIONS

Partial English language translation of the following: Office action dated Sep. 3, 2013 from the Japanese Patent Office in a Japanese patent application corresponding to the instant patent application. This office action translation is submitted now in order to supplement the understanding of patent document JP2005-288883, JP2006-28471. JP01-128954, JP2009-226886, JP2010-5815 and JP2010-6560 which are cited in the office action and are being disclosed in the instant information Disclosure Statement.

* cited by examiner

*Primary Examiner* — Manish S Shah
*Assistant Examiner* — Yaovi Ameh
(74) *Attorney, Agent, or Firm* — SOLARIS Intellectual Property Group, PLLC

(57) ABSTRACT

An image forming method includes applying an ink composition including water, a pigment, a water-soluble organic solvent and polymer particles to a recording medium at an application amount of the ink composition of 6 g/m$^2$ or more with respect to the recording medium, drying by heating the recording medium to which the ink composition has been applied, cooling the recording medium which has been subjected to the drying by heating to reduce a temperature of the recording medium at least 5° C. from the temperature immediately after the drying by heating, applying a powder to the ink composition applied side of the recording medium which has been cooled, and stacking the recording medium to which the powder has been applied.

14 Claims, 1 Drawing Sheet

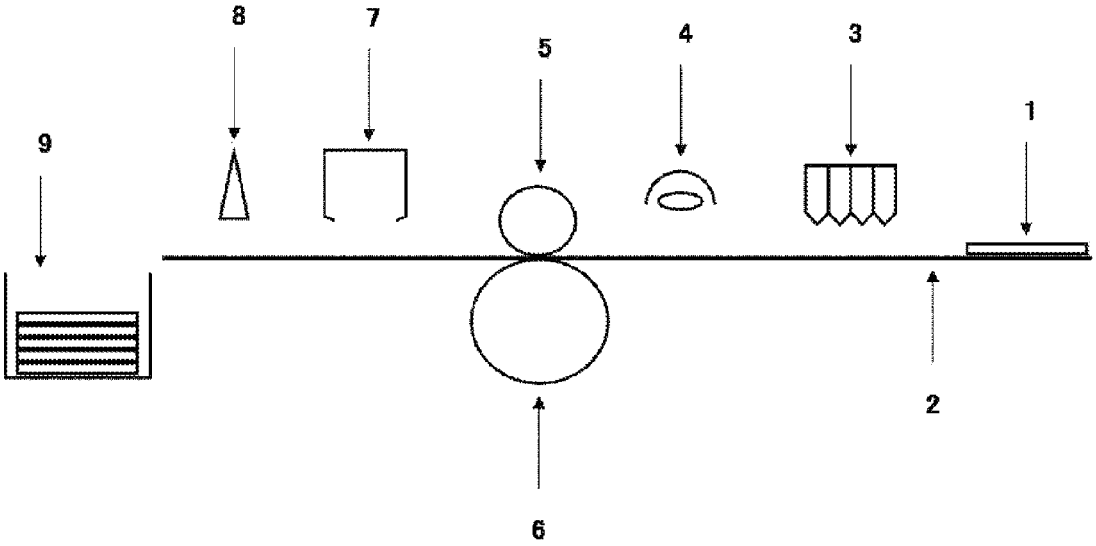
8
7
5
4
3
1
9
2
6

IMAGE FORMING METHOD AND IMAGE FORMING APPARATUS

CROSS-REFERENCE TO RELATED APPLICATIONS

This application is based on and claims priority under 35 USC 119 from Japanese Patent Application No. 2010-173066 filed on Jul. 30, 2010, the disclosure of which is incorporated by reference herein.

BACKGROUND OF THE INVENTION

1. Technical Field

The present invention relates to an image forming method and an image forming apparatus.

2. Description of the Related Art

Inkjet techniques have been applied as an image forming method for forming color images in the field of office printers, home printers, and the like. Recently, inkjet techniques have been applied in commercial printing, and systems capable of large-quantity printing or high-speed printing are demanded. In general, recorded articles obtained by printing are stacked soon after recording. However, a phenomenon in which such stacked prints adhere to each other, and ink adheres to the back side of another print (i.e., blocking) occurs in some cases.

In this connection, in the field of printing, a technique for suppressing the occurrence of a phenomenon in which stacked prints adhere to each other, and ink adheres to the back side of another print (i.e., blocking) is disclosed (for example, Japanese Patent Application Laid-Open No. 2006-231565). In this technique, powder particles (blocking preventive powder) are attached to the surface of paper by being sprayed onto the surface.

SUMMARY OF THE INVENTION

However, the inkjet image forming generally employs a large ink application amount, unlike other printing techniques. Further, in the inkjet image forming, even though drying by heating is conducted after ink application, solvent remains in the ink. Accordingly, blocking between stacked prints may not be sufficiently prevented after high-speed printing in, for example, commercial printing, even in a case in which an ordinary treatment of attaching the powder particles (i.e., blocking preventive powder) described above is performed. Further, in such a case, printed portions may be detached due to rubbing immediately after printing. These trends are remarkable when thick paper is used as a recording medium.

The present invention has been made in view of the above. An object of the invention is to provide an image forming method and an image forming apparatus with which an inkjet image having excellent blocking resistance and excellent rubbing resistance can be formed.

The present invention has been made based on the finding that, in the case of inkjet images with a relatively large ink amount, the effect of the powder application can be enhanced by, in addition to drying by heating, decreasing the temperature by a predetermined degree, as compared to the effect achieved by powder application alone. The present invention has been made based on the finding. Aspects of the invention include the following.

<1> An image forming method including:

applying an ink composition including water, a pigment, a water-soluble organic solvent and polymer particles to a recording medium at an application amount of the ink composition of 6 g/m$^2$ or more;

drying by heating the recording medium to which the ink composition has been applied;

cooling the recording medium, which has been subjected to the drying by heating, to reduce a temperature of the recording medium by at least 5° C. immediately after the drying by heating;

applying a powder to a face of the cooled recording medium to which the ink composition has been applied; and collecting the recording medium, to which the powder has been applied, in a stacking manner.

<2> The image forming method according to <1>, wherein the powder includes at least one selected from the group consisting of starch which is coated with a silicone resin, silica, an acrylic resin, a styrenic resin and a metal oxide.

<3> The image forming method according to <1>, wherein the powder has been subjected to hydrophobization treatment.

<4> The image forming method according to <1>, wherein a volume average particle diameter of the powder is from 5 μm to 60 μm.

<5> The image forming method according to <1>, wherein an amount of the powder applied to the face of the recording medium to which the ink composition has been applied is from 0.1 particles/mm$^2$ to 50 particles/mm$^2$.

<6> The image forming method according to <1>, wherein a minimum film-forming temperature (MFT) of an image formed by the applying of the ink composition is from 40° C. to 80° C.

<7> The image forming method according to <1>, wherein the cooling of the recording medium is performed using a chiller, an air blowing fan, or a Peltier device.

<8> The image forming method according to <1>, wherein the recording medium is paper having a basis weight of from 127 g/m$^2$ to 420 g/m$^2$.

<9> The image forming method according to <1>, further including, after the drying by heating of the recording medium but before the cooling of the recording medium, fixing an image that has been formed on the recording medium by the applying of the ink composition.

<10> The image forming method according to <1>, wherein the collecting of the recording medium in a stacking manner includes cooling the collected and stacked recording medium.

<11> The image forming method according to <1>, further comprising applying a treatment liquid to the recording medium before or after the applying of the ink composition, wherein the treatment liquid includes an aggregating component capable of causing formation of an aggregate by aggregating dispersed particles included in the ink composition.

<12> The image forming method according to <11>, wherein the applying of the treatment liquid is carried out in advance of the applying of the ink composition, and the applying of the ink composition is carried out in such a manner that the applied ink contacts the treatment liquid that has been applied onto the recording medium.

<13> The image forming method according to <1>, wherein the cooling of the recording medium is forced cooling.

<14> The image forming method according to <1>, further comprising cooling the recording medium after the applying of the powder to the face of the cooled recording medium.

<15> An image forming apparatus comprising:

an ink application device that applies an ink composition including water, a pigment, a water-soluble organic solvent and polymer particles to a recording medium at an application amount of the ink composition of 6 g/m$^2$ or more;

a heat-drying device that dries by heating the recording medium to which the ink composition has been applied;

a cooling device that cools the recording medium, which has been subjected to the drying by heating, to reduce a temperature of the recording medium by at least 5° C. immediately after the drying by heating;

a powder application device that applies a powder to a face of the cooled recording medium to which the ink composition has been applied; and a stack-collection mechanism that collects the recording medium, to which the powder has been applied, in a stacking manner.

According to the present invention, an image forming method and an image forming apparatus with which an inkjet image having excellent blocking resistance and excellent rubbing resistance can be formed are provided.

BRIEF DESCRIPTION OF THE DRAWINGS

FIG. 1 is a schematic view showing an example of an apparatus used in an inkjet image forming method of the present invention.

DETAILED DESCRIPTION OF THE INVENTION

The image forming method of the invention includes applying an ink composition including water, a pigment, a water-soluble organic solvent and polymer particles to a recording medium at an application amount of the ink composition of 6 g/m$^2$ or more (ink application process), drying by heating the recording medium to which the ink composition has been applied (heat-drying process), cooling the recording medium, which has been subjected to the drying by heating, to reduce the temperature of the recording medium by at least 5° C. immediately after the drying by heating (cooling process), applying a powder to a face (ink composition applied-face) of the cooled recording medium to which the ink composition has been applied (powder application process), and collecting the recording medium, to which the powder has been applied, in a stacking manner (stack-collection process).

A preferable example of the image forming method of the present invention is described below with reference to the schematic drawing of the apparatus illustrated in FIG. 1. A recording medium 1 is fed by, for example, a conveying belt 2, and the ink composition is ejected from an ink application device 3, such as an inkjet nozzle, toward the recording medium to form an image recorded on the recording medium. The recording medium on which the image is formed (print) is dried by heating by using a heat-drying device 4 such as a drier, and is conveyed to a fixing device. The fixing device is provided with a heating roller (fixing roller) 5 and a pressure application roller 6. The print conveyed to the fixing device passes between the heating roller 5 and the pressure application roller 6, as a result of which the image formed on the recording medium is fixed. Next, the recording medium is cooled by a cooling device 7 to reduce the temperature of the recording medium to be at least 5° C. less than the temperature of the recording medium immediately after the drying by heating. Thereafter, a powder is applied to the ink composition applied-face of the recording medium, using a powder application device 8. Next, the recording medium is discharged from a discharge opening, and the discharged recording media 1 are collected and stacked at a stack-collection mechanism 9, such as a discharge tray.

1. Ink Application Process

The ink application process of the present invention is a process of forming (recording) an image on a recording medium by an inkjet method.

(InkJet Method)

The inkjet method is not particularly limited, and may be any known method such as a charge-control method in which ink is ejected by electrostatic attraction force; a drop-on-demand method (pressure-pulse method) in which a pressure of oscillation of a piezo element is utilized; an acoustic inkjet method in which ink is ejected by radiation pressure generated by irradiation of ink with acoustic beams that have been converted from electric signals; and a thermal inkjet method in which ink is ejected by a pressure generated by formation of bubbles caused by heating of ink (BUBBLEJET, registered trademark). Here, examples of the inkjet method include a method in which a large number of small-volume droplets of an ink having a low optical density, which is called photo ink, are ejected; a method in which inks having substantially the same hue but at different densities are used to improve image quality; and a method in which a clear and colorless ink is used.

The inkjet head used in the inkjet method may be either an on-demand type head or a continuous type head. Examples of ejection systems include electromechanical transduction systems (such as a single-cavity system, a double-cavity system, a vendor system, a piston system, a share-mode system and a shared-wall system), electrothermal transduction systems (such as a thermal inkjet system and a BUBBLE-JET (registered trademark) system), electrostatic suction systems (such as an electric-field-control system and a slit-jet system), and discharge systems (such as a spark jet system), and any of these ejection systems is applicable.

The ink nozzles and the like used for the inkjet recording are not particularly limited, and may be selected as appropriate according to applications.

Regarding the inkjet head, there are (i) a shuttle system in which recording is performed while a short serial head having a small length is moved in the width direction of the recording medium in a scanning manner, and (ii) a line system in which a line head having recording devices that are aligned to correspond to the entire length of one side of a recording medium is used. In the line system, image recording can be performed over the whole of one surface of a recording medium by moving the recording medium in a direction orthogonal to the direction along which the recording devices are aligned, and a conveyance system, such as carriage, which moves the short head in a scanning manner is unnecessary. Since a complicated scan-movement control of the movement of the carriage and the recording medium is unnecessary and only the recording medium is moved, the recording speed can be increased compared to the shuttle system. The image forming method of the invention can be applied to both of these systems; effects in improving the ejection accuracy and rubbing resistance of an image are larger when the image forming method of the invention is applied to a line system, in which dummy ejection is generally not performed.

The ink application process in the image forming method of the invention may be carried out in a multi-pass manner or a single-pass manner. The ink application process is more preferably carried out in a single-pass manner, which is capable of high speed printing, since effects in prevention of the blocking are more conspicuous.

The amount of the ink composition per droplet ejected from the inkjet head is preferably from 0.5 pl to 15 pl, more preferably from 1 pl to 12 pl, and still more preferably from 2 pl to 10 pl, from the viewpoint of obtaining a high resolution image.

The amount of the ink composition to be applied to the recording medium is 6 g/m$^2$ or more, preferably from 6 to 20 g/m$^2$, and more preferably from 6 to 13 g/m$^2$. When the amount of the ink composition applied to the recording medium is less than 6 g/m$^2$, sufficient color density cannot be obtained, and vividness of the image may not be sufficient. It is advantageous that the amount of the ink composition to be applied to the recording medium is 8 g/m$^2$ or more, from the viewpoint of achieving a favorable color reproduction range.

(Recording Medium)

In the image forming method of the invention, an image is formed on a recording medium.

The recording medium is not particularly limited, and may be a cellulose-based general printing paper, such as high-quality paper, coat paper, or art paper, that is used for general offset printing and the like.

The recording medium may be a commercially-available product, and examples thereof include high-quality papers (A) such as PRINCE WOOD FREE (tradename) manufactured by Oji Paper Co., Ltd., SHIRAOI (tradename) manufactured by Nippon Paper Industries Co., Ltd., and New NPI jo-shitsu (New NPI high-quality; tradename) manufactured by Nippon Paper Industries Co., Ltd.; very light weight coated papers such as EVER LIGHT COATED (tradename) manufactured by Oji Paper Co., Ltd. and AURORA S (tradename) manufactured by Nippon Paper Industries Co., Ltd.; lightweight coat papers (A3) such as TOPKOTE (L) (tradename) manufactured by Oji Paper Co., Ltd. and AURORA L (tradename) manufactured by Nippon Paper Industries Co., Ltd.; coat papers (A2, B2) such as TOPKOTE PLUS (tradename) manufactured by Oji Paper Co., Ltd. and AURORA COAT (tradename) manufactured by Nippon Paper Industries Co., Ltd.; and art papers (A1) such as 2/SIDE GOLDEN CASK GLOSS (tradename) manufactured by Oji Paper Co., Ltd. and TOKUBISHI ART (tradename) manufactured by Mitsubishi Paper Mills Ltd. As the recording medium, various inkjet-recording papers exclusively for photos may be used.

Among recording media, coated paper, which is used for general offset printing, is preferable. The coated paper is produced generally by coating a surface of cellulose-based paper (such as high-quality paper or neutral paper) that has not been subjected to surface treatment, with a coating material so as to form a coating layer. In particular, it is preferable to use a coated paper having base paper and a coated layer including kaolin and/or calcium bicarbonate. Specifically, art paper, coated paper, lightweight coat paper, or very light weight coat paper is preferable.

In conventional techniques, in a case in which images are formed on thick paper sheets, the temperature after inkjet image formation and drying is slow. Therefore, when the thick paper sheets on which the image has been formed are stacked at a stack-collection part, blocking tends to occur in conventional techniques due to the weight of the paper sheets themselves. Blocking that would occur in such a case can be effectively prevented when the image forming method of the present invention is employed. The basis weight of paper which can be used as a recording medium in the present invention is preferably from 127 g/m$^2$ to 420 g/m$^2$, and more preferably from 157 g/m$^2$ to 310 g/m$^2$.

(Ink Composition)

The ink composition used in the present invention is not particularly limited, as long as it includes water, a pigment, a water-soluble organic solvent and polymer particles, and known or commercially available ink compositions can be used.

(Pigment)

The pigment can be selected from known pigments, without particular restrictions. In particular, a pigment that is poorly soluble in water or practically insoluble in water is preferable from the viewpoint of ink coloring properties. In the present invention, a water-insoluble pigment per se or a pigment that has been surface-treated with a dispersant may be used as a colorant.

The type of pigment in the present invention is not particularly limited, and the pigment may be a conventional known organic or inorganic pigment. Examples of organic pigments include azo lakes, azo pigments, polycyclic pigments such as phthalocyanine pigments, perylene pigments, perinone pigments, anthraquinone pigments, quinacridone pigments, dioxazine pigments, diketopyrrolopyrrole pigments, thioindigo pigments, isoindolinone pigments, and quinophthalone pigments, dye lakes such as basic dye lakes and acidic dye lakes, organic pigments such as nitro pigments, nitroso pigments, aniline black, and daylight fluorescent pigments. Examples of inorganic pigments include titanium oxide pigments, iron oxide pigments, and carbon black pigments. Pigments that are not described in the Color Index may be used if they are dispersible in an aqueous phase. Further examples of pigments that may be used include those obtained by surface-treating the above pigments with a surfactant or a polymeric dispersant, and graft carbon. Of these pigments, preferable pigments for use include azo pigments, phthalocyanine pigments, anthraquinone pigments, quinacridone pigments, and carbon black pigments.

Specific examples of organic pigments which may be used in the present invention are shown below. The following colorants may be used singly, or in combination of two or more thereof.

Examples of organic pigments for orange or yellow include C. I. pigment orange 31, C. I. pigment orange 43, C. I. pigment yellow 12, C. I. pigment yellow 13, C. I. pigment yellow 14, C. I. pigment yellow 15, C. I. pigment yellow 17, C. I. pigment yellow 74, C. I. pigment yellow 93, C. I. pigment yellow 94, C. I. pigment yellow 128, C. I. pigment yellow 138, C. I. pigment yellow 151, C. I. pigment yellow 155, C. I. pigment yellow 180, and C. I. pigment yellow 185.

Examples of organic pigments for magenta or red include C. I. pigment red 2, C. I. pigment red 3, C. I. pigment red 5, C. I. pigment red 6, C. I. pigment red 7, C. I. pigment red 15, C. I. pigment red 16, C. I. pigment red 48:1, C. I. pigment red 53:1, C. I. pigment red 57:1, C. I. pigment red 122, C. I. pigment red 123, C. I. pigment red 139, C. I. pigment red 144, C. I. pigment red 149, C. I. pigment red 166, C. I. pigment red 177, C. I. pigment red 178, C. I. pigment red 222, and C. I. pigment violet 19.

Examples of organic pigments for green or cyan include C. I. pigment blue 15, C. I. pigment blue 15:2, C. I. pigment blue 15:3, C. I. pigment blue 15:4, C. I. pigment blue 16, C. I. pigment blue 60, C. I. pigment green 7, and siloxane-bridged aluminum phthalocyanine described in the specification of U.S. Pat. No. 4,311,775.

Examples of organic pigments for black include C. I. pigment black 1, C. I. pigment black 6, and C. I. pigment black 7.

The pigment used in the invention may be dispersed in an aqueous solvent in the presence of a dispersant. The dispersant may be a polymeric dispersant or a low-molecular-weight surfactant-type dispersant. The polymeric dispersant may be a water-soluble dispersant or a water-insoluble dispersant.

Among water-soluble dispersants in the present invention, hydrophilic polymer compounds can be used as water-soluble dispersants. Examples of natural hydrophilic polymer compounds include vegetal polymers, such as gum arabic, gum tragan, guar gum, karaya gum, locust bean gum, arabinogalacton, pectin, and quince seed starch; seaweed polymers, such as alginic acid, carrageenen, and agar; animal polymers, such as gelatin, casein, albumin, and collagen; and microorganism polymers, such as xanthan gum and dextran.

Examples of chemically-modified hydrophilic polymer compounds obtained by chemical modification using natural products as raw materials include cellulose polymers, such as methyl cellulose, ethyl cellulose, hydroxyethyl cellulose, hydroxypropyl cellulose, and carboxymethyl cellulose; starch polymers, such as sodium starch glycolate and sodium starch phosphate; and seaweed polymers, such as propylene glycol alginate.

Examples of synthetic water-soluble polymer compounds include vinyl polymers, such as polyvinyl alcohol, polyvinyl pyrrolidone, and polyvinyl methyl ether; acrylic resins, such as polyacrylamide, polyacrylic acid and alkali metal salts thereof, and water-soluble styrene-acrylic resins, water-soluble styrene-maleic acid resins, water-soluble vinyl naphthalene-acrylic resins, water-soluble vinyl naphthalene-maleic acid resins, polyvinylpyrrolidone, polyvinylalcohol, alkali metal salts of β-naphthalenesulfonic acid formaldehyde condensate, and polymer compounds having, at a side chain thereof, a salt of a cationic functional group such as a quaternary ammonium or an amino group.

Among polymeric dispersants, polymers having both a hydrophobic portion and a hydrophilic portion can be used as water-insoluble dispersants. Examples thereof include styrene-(meth)acrylic acid copolymers, styrene-(meth)acrylic acid-(meth)acrylic acid ester copolymers, (meth)acrylic acid ester-(meth)acrylic acid copolymers, polyethylene glycol (meth)acrylate-(meth)acrylic acid copolymers, and styrene-maleic acid copolymers.

From the viewpoint of providing favorable aggregating properties when contacting a treatment liquid, the acid value of the polymeric dispersant is preferably 100 mgKOH/g or less. The acid value is more preferably from 25 mgKOH/g to 100 mgKOH/g, and particularly preferably from 30 mgKOH/g to 90 mgKOH/g.

The average particle diameter of the pigment is preferably from 10 nm to 200 nm, more preferably from 10 nm to 150 nm, and still more preferably from 10 nm to 100 nm. An average particle diameter of 200 nm or less realizes excellent color reproduction and, in an inkjet method, excellent ejection properties. An average particle diameter of 10 nm or more realizes excellent light fastness.

The particle diameter distribution of the pigment particles is not particularly limited, and may be a broad particle diameter distribution or a monodispersed particle diameter distribution. In an embodiment, two or more types of pigment particles having a monodispersed particle diameter distribution may be used in mixture.

From the image density viewpoints, the content of pigment in the ink composition is preferably from 1% by mass to 25% by mass, and more preferably from 2% by mass to 20% by mass, with respect to the ink composition.

(Polymer Particles)

The ink composition used in the present invention includes polymer particles. This can realize further improvement in, for example, the rubbing resistance and fixability of images.

Examples of the polymer particles which can be used in the present invention include particles of a resin having an anionic group, and specific examples of the resin include: thermoplastic, thermosetting, or modified, acryl-based, epoxy-based, polyurethane-based, polyether-based, polyamide-based, unsaturated polyester-based, phenol-based, silicone-based, or fluorine-containing resins; polyvinyl-based resins, such as vinyl chloride, vinyl acetate, polyvinyl alcohol, and polyvinyl butyral; polyester-based resins, such as alkyd resins and phthalic acid resins; amino-based materials, such as melamine resins, melamine-formaldehyde resins, aminonalkyd co-condensate resins, and urea resins; and copolymers or mixtures thereof. Among them, anionic acryl-based resins can be obtained by polymerizing, for example, an acrylic monomer having an anionic group (anionic group-containing acrylic monomer) and, optionally, another monomer that can be copolymerized with the anionic group-containing acrylic monomer in a solvent. Examples of the anionic group-containing acrylic monomer include acrylic monomers having at least one selected from the group consisting of a carboxy group, a sulfonic acid group, and a phosphonic acid group. Among them, preferable examples of the anionic group-containing acrylic monomer include acrylic monomers having a carboxyl group (for example, acrylic acid, methacrylic acid, crotonic acid, ethacrylic acid, propylacrylic acid, isopropylacrylic acid, itaconic acid, and fumaric acid), and more preferable examples of the anionic group-containing acrylic monomers include acrylic acid and methacrylic acid. The polymer particles may include only one kind of polymer particle, or a mixture of two or more kinds of polymer particle.

The molecular weight range of the polymer particles used in the present invention is, in terms of weight-average molecular weight, preferably from 3,000 to 200,000, more preferably from 5,000 to 150,000, and still more preferably from 10,000 to 100,000. The weight-average molecular weight is measured by gel permeation chromatography (as a polystyrene-equivalent value).

The average particle diameter of the polymer particles is, in terms of volume average particle diameter, preferably in a range of from 10 nm to 400 nm, more preferably in a range of from 10 nm to 200 nm, still more preferably in a range of from 10 nm to 100 nm, and particularly preferably in a range of from 10 nm to 50 nm. When the average particle diameter is within the above ranges, for example, production suitability and storage stability can be improved. The average particle diameter of the polymer particles is obtained by measuring the volume average particle diameter by a dynamic light scattering method using a NANOTRAC particle size distribution measuring device UPA-EX150 (trade name, manufactured by Nikkiso Co., Ltd.).

From the viewpoints of, for example, the glossiness of images, the content of polymer particles in the ink composition is preferably from 1% by mass to 30% by mass, and more preferably from 3% by mass to 20% by mass, with respect to the ink composition.

(Water)

The ink composition includes water, and the content of water is not particularly limited. The content of water is preferably from 10% by mass to 99% by mass, more preferably from 30% by mass to 80% by mass, and still more preferably from 50% by mass to 70% by mass, with respect to the ink composition.

(Organic Solvent)

The ink composition includes a water-soluble organic solvent. The water-soluble organic solvent is preferably an alkyleneoxy alcohol, from the viewpoint of ejection properties. In particular, the ink composition preferably includes two or more hydrophilic organic solvents including at least one alkyleneoxy alcohol and at least one alkyleneoxy alkyl ether.

The alkyleneoxy alcohol is preferably propyleneoxy alcohol, and examples of propyleneoxy alcohol include SUNNIX GP 250 and SUNNIX GP 400 (trade names, all manufactured by Sanyo Chemical Industries Ltd.).

The alkyleneoxy alkyl ether is preferably an ethyleneoxy alkyl ether of which the alkyl portion has from 1 to 4 carbon atoms, or a propyleneoxy alkyl ether of which the alkyl portion has from 1 to 4 carbon atoms. Specific examples of alkyleneoxy alkyl ethers include ethylene glycol monomethyl ether, ethylene glycol monoethyl ether, ethylene glycol monobutyl ether, diethylene glycol monomethyl ether, diethylene glycol monobutyl ether, propylene glycol monomethyl ether, propylene glycol monobutyl ether, dipropylene glycol monomethyl ether, triethylene glycol monomethyl ether, triethylene glycol monomethyl ether, and triethylene glycol monoethyl ether.

Examples of the water-soluble organic solvent further include ethylene glycol diacetate, ethylene glycol monomethyl ether acetate, and ethylene glycol monophenyl ether.

Furthermore, in addition to the hydrophilic organic solvent, the ink composition may further include one or more additional organic solvents for the purposes of, for example, drying prevention, permeation acceleration, and viscosity adjustment, as necessary.

(Other Additives)

The ink composition may further include one or more other additives, as necessary. Examples of other additives include known additives, such as a polymerizable compound that is polymerized by active energy rays, a polymerization initiator, an anti-fading agent, an emulsification stabilizer, a permeation accelerating agent, an ultraviolet absorbent, an antiseptic agent, an antifungal agent, a pH adjuster, a surface tension controller, a defoamer, a viscosity adjuster, a wax, a dispersion stabilizer, a rust-preventive agent, and a chelating agent. Theses additives may be directly added after the preparation of the ink composition or may be added during the preparation of the ink composition.

2. Heat-Drying Process

Next, the recording medium is dried by heating using a heat-drying device. The heat-drying method is not particularly limited, and preferable examples of the heat-drying method include a non-contact drying method, such as a method in which warm or hot air is supplied by a conventional drying device such as a dryer, a method of heating with a heat generator such as a NICHROME wire heater, or a method of heating with a halogen lamp, an infrared lamp, or the like.

With respect to the heating temperature in the heat-drying process, the recording medium is preferably heated to a temperature in a range of from 40° C. to 100° C., and is more preferably heated to a temperature in a range of from 50° C. to 85° C. The temperature of the recording medium immediately after the heat-drying process can be measured using, for example, an ordinary temperature sensor.

The heat-drying time is preferably from 0.2 sec to 10.0 sec, and more preferably from 3.0 sec to 8.0 sec.

The temperature of the recording medium is a temperature of a blank area onto which the ink composition has not been applied (the same applies to the temperature of the recording medium in the following processes).

(Fixing Process)

The image forming method of the present invention may further include, after the heat-drying process, fixing the image on the recording medium (fixing process). By conducting the fixing process, the rubbing resistance of the image can be further improved. However, the fixing process is not essential, and may be omitted.

The fixing process may be performed by, for example, subjecting the recording medium surface to heating and/or pressure application treatment. The heating temperature of the treatment is preferably in the range of from 40° C. to 150° C., more preferably in the range of from 50° C. to 100° C., and still more preferably in the range of from 60° C. to 90° C.

The pressure in the case of applying heat and pressure together is preferably in the range of from 0.1 MPa to 3.0 MPa, more preferably from 0.1 MPa to 1.0 MPa, and still more preferably from 0.1 MPa to 0.5 MPa, from the viewpoint of smoothing the surface.

The heating method is not particularly limited, and preferable examples thereof include a noncontact drying method, such as a method of heating with a heat generator such as a NICHROME wire heater, a method of supplying warm or hot air, or a method of heating with a halogen lamp, an infrared lamp, or the like. The method of applying heat and pressure is not particularly limited, and preferable examples thereof include a contact thermal fixing method, such as a method of pressing a hot plate against an image-formed surface of the recording medium, a method in which a heat-pressure application apparatus is used to pass the recording medium through a pair of roller or another type of pressure contact portion, wherein the heat-pressure application apparatus may have a pair of heating rollers or a pair of heat pressure application belts, or may have a heat-pressure application belt disposed at the image-recorded surface of the recording medium and a support roller disposed at the opposite side of the recording medium.

When heat and pressure are applied, a nip time is preferably from 1 msec to 10 sec, more preferably from 2 msec to 1 sec, and still more preferably from 4 msec to 100 msec. The nip width is preferably from 0.1 mm to 100 mm, more preferably from 0.5 mm to 50 mm, and still more preferably from 1 mm to 10 mm.

When a heating roller is used, the heating roller may be a metal roller made of metal, or a roller having a metal core of which outer surface is covered with a coating layer made of an elastic material and, optionally, a surface layer (also referred to as a release layer). The metal core in the latter case may be, for example, a cylindrical body made of iron, aluminum, or SUS (stainless steel). It is preferable that at least a part of the surface of the metal core is coated with a coating layer. The coating layer is preferably formed by a silicone resin or fluororesin, each of which has release properties. It is preferable that a heat generator is placed in the interior of the metal core of one of the heating rollers. Heating treatment and pressure application treatment may be performed simultaneously by passing the recording medium between rollers. In an embodiment, the recording medium is heated by being nipped between two heating rollers, if necessary. Preferable examples of the heat generator include a halogen lamp heater, a ceramic heater, and a NICHROME wire.

When a heat-pressure application belt is used, the belt substrate thereof is preferably a seamless electroformed nickel, and the thickness of the substrate is preferably from 10 μm to 100 μm. Examples of the material of the belt substrate include aluminum, iron and polyethylene, as well as nickel. When a silicone resin layer or a fluororesin layer is provided, the thickness of the layer formed by the resin is preferably from 1 μm to 50 μm, and more preferably from 10 μm to 30 μm.

In order to obtain a pressure (nip pressure) of the above range, elastic members that exhibit tension, such as a spring, may be selected and disposed at both ends of the roller (for example, a heating roller), such that a desired nip pressure can be obtained in consideration of the nip gap.

The conveyance speed of the recording medium is preferably from 200 mm/sec to 700 mm/sec, more preferably from 300 mm/sec to 650 mm/sec, and still more preferably from 400 mm/sec to 600 mm/sec.

In the image forming method of the present invention, a drying process may be optionally performed by providing, for example, an ink drying zone between the recording process and the application process, between the application process and the fixing process, and/or after the fixing process.

3. Cooling Process

After the heat-drying process, the recording medium is cooled by a cooling device. In an embodiment, the cooling is forced cooling. Examples of the cooling device include a chiller, an air-blowing fan, a Peltier device, a radiation fin, a refrigerant circulation cooling device. In the present invention, a chiller, an air-blowing fan or a Peltier device is preferred.

A chiller may be, for example, connected to a supply pipe through which a cooling medium is supplied. The recording medium can be cooled by performing thermal exchange while supplying a cooling medium from the supply pipe.

An air-blowing fan may be, for example, connected to an air-blow control device. The recording medium can be cooled by blowing air to the recording medium by rotating the air-blowing fan at a rotation number decided as appropriate.

A Peltier device may be, for example, provided at a member through which the recording medium immediately after heat-drying passes. The recording medium can be cooled by controlling the driving of the Peltier device based on temperature detection signals outputted from a thermistor.

By the cooling process, the temperature of the recording medium is reduced by at least 5° C., more preferably by from 10° C. to 40° C., from the temperature of the recording medium immediately after the heat-drying process. By applying a powder in a subsequent process while the recording medium is in the temperature-reduced state, blocking resistance of thick paper, and rubbing resistance of thick paper immediately after printing, can be improved.

The temperature of the recording medium is more preferably reduced to a temperature lower than the minimum film-forming temperature (MFT) of an image formed by applying the ink composition, from the viewpoints of blocking resistance and rubbing resistance of thick paper immediately after printing.

The minimum film-forming temperature is defined as follows. An aqueous dispersion including polymer particles at a solid concentration of 25% is coated, and the resultant coating layer is dried while heating such that a temperature gradient is formed within the film. The minimum film-forming temperature refers to the boundary temperature (° C.) between a temperature range in which a white powdery precipitate is generated and a temperature range in which a transparent film is formed, The MFT of an image refers to the MFT of a mixture of the polymer particles, water and the water-soluble organic solvent, which are to be included in the ink, as measured by the method described above.

The mixing ratio (by mass) between polymer particles, water, and water-soluble organic solvent in the mixture liquid for measuring MFT is as follows.

Polymer particles:water:water-soluble organic solvent

=the amount of polymer particles contained in the ink composition:half the amount of water contained in the ink composition:a quarter of the amount of water-soluble organic solvent contained in the ink composition The MFT of an image formed by applying the ink composition is preferably from 40° C. to 80° C., and more preferably from 45° C. to 70° C.

In the present invention, from the viewpoint of blocking prevention, it is also preferable that the recording medium is cooled after applying the powder, by a cooling device such as those described above; the cooling after applying the powder may be carried out, for example, at the stack-collection mechanism.

4. Powder Application Process

Next, a powder application device is used so as to apply a powder to the ink composition applied-face of the cooled recording medium which has been cooled. The powder application device may employ a member, such as a powder spray nozzle, which has conventionally been used as a member for applying a powder for blocking prevention. The powder application device may be, for example, a blower type device, or an electronic spraying type device.

Examples of the powder particles to be applied include inorganic particles and organic particles. The powder may be a conventionally-used blocking prevention powder.

Preferable examples of the powder include powder of starch coated with a silicone resin, silica (silicon dioxide), an acrylic resin, a styrenic resin, silicone powder or a metal oxide.

Preferable examples of the acrylic resin include poly(methyl acrylate) and poly(methyl methacrylate) (PMMA).

Examples of the styrenic resin include polystyrene.

Examples of metal oxide include titanium oxide, magnesium oxide and aluminum oxide.

The ink composition for inkjet for use in the present invention tends to have a high water content, compared to other printing inks Accordingly, in order to enhance the anti-blocking effect, the powder is preferably hydrophobic. The powder is more preferably a powder that has been subjected to hydrophobization treatment, such as a powder of starch coated with a silicone resin.

In the present invention, the particle diameter of the powder is preferably from 5 μm to 50 μm, more preferably from 10 μm to 40 μm, and still more preferably from 15 μm to 35 μm. An excessively large particle diameter of the powder may cause image roughness after printing, and staining due to the powder in the printing machine, and an excessively small particle diameter of the powder may result in insufficiency of the resultant anti-blocking effect.

In the present invention, the term "particle diameter" refers to a volume average particle diameter.

The application amount of the powder on the ink composition applied-face of the recording medium is preferably from 0.1 particles/$mm^2$ to 50 particles/$mm^2$, more preferably from 0.5 particles/$mm^2$ to 30 particles/$mm^2$, and still more preferably from 1 particles/$mm^2$ to 15 particles/$mm^2$. An excessively large application amount of the powder may result in decreased image quality, and an excessively small application amount of the powder may result in insufficiency of the resultant anti-blocking effect.

5. Stack-Collection Process

The recording media to which the powder has been applied are collected and stacked by the stack-collection mechanism. The stack-collection mechanism may be a stack-collection mechanism used in conventional inkjet image forming apparatuses, such as a discharging device, a discharge opening and/or a paper stacking table. The recording media to which the powder has been applied are discharged from a discharge opening, and stacked on the paper staking table. The recording media collected and stacked in the stack-collection process are preferably cooled with a cooling device, such as those described above, since a further-improved anti-blocking effect can be obtained by the further enhanced cooling effect.

According to the image forming method of the present invention, even in a case in which thick paper is used as a recording medium and an image of high ink application amount is formed thereon, it is possible to suppress occurrence of blocking due to the stacking and occurrence of image detachment due to rubbing.

(Treatment Liquid Application Process)

The image forming method of the present invention may further include applying a treatment liquid to the recording medium (treatment liquid application process). In the treatment liquid application process, the treatment liquid capable of causing formation of an aggregate when contacting the ink composition is applied to the recording medium, thereby contacting the treatment liquid with the ink composition. When the treatment liquid contacts the ink composition, dispersed particles, such as polymer particles and a colorant (for example, a pigment), in the ink composition aggregate, as a result of which an image is fixed to the recording medium.

The application of the treatment liquid can be performed by a known method such as a coating method, an inkjet method, or a dip method. The coating method may be a known coating method such as a method using a bar coater, an extrusion die coater, an air doctor coater, a blade coater, a rod coater, a knife coater, a squeeze coater, a reverse roll coater, or the like. The specifics of the inkjet method are as described above.

The treatment liquid application process may be conducted either before or after the ink application process in which the ink composition is used.

In the present invention, it is preferable that the ink application process is conducted after the application of the treatment liquid performed in the treatment liquid application process. That is, it is preferable that the treatment liquid for aggregating a colorant (preferably a pigment) in the ink composition is applied onto the recording medium in advance of the application of the ink composition, and that the ink composition is applied so as to contact the treatment liquid that has been applied onto the recording medium, thereby forming an image. Inkjet recording at a higher speed can be realized thereby, and an image having high density and high resolution can be obtained even when high-speed recording is performed.

The amount of the treatment liquid to be applied is not particularly limited as long as the treatment liquid is capable of coagulating the ink composition. The amount of the treatment liquid to be applied is preferably such an amount as to adjust the amount of aggregating component (such as a di- or higher-valent carboxylic acid or a cationic organic compound) applied to be 0.1 $g/m^2$ or higher. The amount of the treatment liquid is more preferably such that the amount of the aggregating component applied is adjusted to be from 0.1 to 1.0 $g/m^2$, still more preferably such that the amount of the aggregating component applied is adjusted to be from 0.2 to 0.8 $g/m^2$. When the amount of the aggregating component applied is 0.1 $g/m^2$ or more, the aggregation reaction proceeds favorably. An application amount of the aggregating component of 1.0 $g/m^2$ or less is preferable from the viewpoint of gloss.

The treatment liquid in the present invention is capable of causing aggregation when contacting the inkjet ink composition described above. Specifically, the treatment liquid preferably includes an aggregating component capable of causing formation of an aggregate by aggregating dispersed particles, such as colorant particles (for example, a pigment), included in the ink composition. The treatment liquid may further include one or more other components, as necessary. Use of the treatment liquid with the ink composition realizes inkjet recording at a higher speed, and realizes formation of an image having high density, high resolution, and excellent print properties (such as reproduction of thin lines and fine areas) even at a high recording speed.

The treatment liquid may include at least one aggregating component capable of causing an aggregate when contacting the ink composition. As a result of the treatment liquid mixing into the ink composition deposited by an inkjet method, aggregation of pigment and the like that have been stably dispersed in the ink composition is promoted.

Examples of the other components (other additives) described above include known additives such as an anti-drying agent (humectant), an anti-fading agent, an emulsification stabilizer, a permeation accelerating agent, an ultraviolet absorbent, an antiseptic agent, an antifulgal agent, a pH adjuster, a surface tension controller, a defoamer, a viscosity adjuster, a dispersant, a dispersion stabilizer, a rust-preventive gent, and a chelating agent. The additives described as specific examples of "other additives" contained in the ink composition described above may be used as the other components in the treatment liquid.

6. Inkjet Image Forming Apparatus

The image forming apparatus of the present invention is an apparatus with which the image forming method of the present invention can be suitably performed. The structures and the functions of the individual devices contained therein are as described above.

EXAMPLES

The present invention is described in further detail below by reference to examples. However, the examples should not be construed as limiting the scope of the present invention. Hereinafter, "part(s)" and "%" are based on mass, unless otherwise specified.

The weight average molecular weights were measured using a gel permeation chromatography (GPC). The GPC was performed using a GPC instrument, HLC-8220GPC manufactured by Tosoh Corporation, three serially-connected columns of TSKGEL SUPER HZM-H, TSKGEL SUPER HZ4000, and TSKGEL SUPER HZ2000 (tradenames, all manufactured by Tosoh Corporation), and THF (tetrahydrofuran) was used as an eluent. Regarding the GPC conditions, the sample concentration was 0.45% by mass, the flow rate was 0.35 ml/min, the sample injection amount was 10 μA, and the measurement temperature was 40° C. The detection was performed by using a refractive index (RI) detector. The calibration curve was determined from the following eight standard samples: TSK STANDARD POLYSTYRENEs of F-40, F-20, F-4, F-1, A-5000, A-2500, A-1000, and n-propylbenzene, all manufactured by Tosoh Corporation. The acid values were determined by the method described in Japan Industrial Standards (JIS K0070:1992).

Example 1

<Ink Composition>

An ink composition was prepared by adding ion exchange water to the following ingredients such that the total amount of the following ingredients and the ion exchange water was 100% by mass.

(Composition of Cyan Ink C1)

Cyan ink C1 was prepared so as to have the following composition.

Cyan pigment (Pigment Blue 15:3): 4% by mass

Acrylic polymer dispersant (acid value: 65.2 mgKOH/g, weight average molecular weight: 44600): 2% by mass Aqueous dispersion of acrylic polymer particles (solid content: 28% by mass, weight average molecular weight: 66,000): 14% by mass SANNIX GP250 (water-soluble organic solvent) (trade name, manufactured by Sanyo Chemical Industries Ltd.): 9% by mass Tripropyleneglycol monomethyl ether (water-soluble organic solvent): (manufactured by Wako Pure Chemical Industries Ltd.) 7% by mass OLFINE E1010 (surfactant) (tradename, manufactured by Nissin Chemical Industry Co., Ltd.): 1%

Microcrystalline wax (trade name: HI-MIC1090, manufactured by Nippon Seiro Co., Ltd.) 2% by mass (Composition of Magenta Ink M1)

Magenta ink M-1 was prepared so as to have the same composition as cyan ink C1 except that the cyan pigment in cyan ink C1 was replaced with the same amount of a magenta pigment (Pigment Red 122).

(Composition of Yellow Ink Y1)

Yellow ink Y-1 was prepared so as to have the same composition as cyan ink C1 except that the cyan pigment in cyan ink C1 was replaced with the same amount of a yellow pigment (Pigment Yellow 74).

(Composition of Black Ink B1)

Black ink B-1 was prepared so as to have the same composition as cyan ink C1 except that the cyan pigment in cyan ink C1 was replaced with the same amount of a black pigment (carbon black).

<Preparation of Treatment Liquid>

Ingredients are mixed to form the following composition, thereby preparing a treatment liquid.

Malonic acid (divalent carboxylic acid, manufactured by Wako Pure Chemical Industries Ltd.): 15.0% by mass Diethyleneglycol monomethyl ether (manufactured by Wako Pure Chemical Industries Ltd.): 20.0% by mass N-oleoyl-N-methyltaurine sodium salt (surfactant): 1.0% by mass Ion-exchange water: 64.0% by mass Regarding the physical properties of the treatment liquid, the viscosity was 2.6 mPa·s, the surface tension was 37.3 mN/m, and the pH was 1.6.

The surface tension was measured using an automatic surface tensiometer CBVP-Z (tradename, manufactured by Kyowa Interface Science Co., Ltd.) at 25° C. by a Wilhelmy method using a platinum plate.

The viscosity was measured using a viscometer TV-22 (trade name, manufactured by Toki Sangyo Co., Ltd.) at a temperature of 30° C.

The pH was measured using a pH meter WM-50EG (trade name, manufactured by To a DKK corporation), and the measurement of an undiluted liquid was performed at a temperature of 25° C.

The volume average particle diameter was measured using a particle size distribution measurement instrument NANOTRAC UPA-EX150 (trade name, manufactured by NIKKISO CO., LTD.). For the measurement, a measurement sample liquid was prepared by adding 10 ml of ion exchange water to 100 μl of a 20% by mass aqueous dispersion of the powder particles. The temperature of the measurement sample liquid was adjusted to 25° C., and the measurement was performed on the measurement sample liquid.

A GELJET GX5000 printer head, a full-line head manufactured by Ricoh Company Ltd., was prepared, and the storage tanks connected thereto were respectively filled with cyan ink C1, magenta ink M1, yellow ink Y1 and black ink K1 obtained above. As a recording medium, a sheet of AIBESUTO W (trade name, manufactured by Nippon Daishowa Paperboard Co., Ltd., basis weight of 310 g/cm$^2$) was used. The recording medium was fixed onto a stage (conveying belt) capable of moving in a predetermined linear direction at a speed of 500 mm/second, and the treatment liquid obtained above was applied onto the recording medium with a wire bar coater so as to obtain a coating thickness of about 1.5 μm (equivalent to 0.34 g/m$^2$ of malonic acid). Immediately after the application of the treatment liquid, the coating was dried at 50° C. for 2 seconds.

Thereafter, the GELJET GX5000 printer head, a full-line head manufactured by Ricoh Company Ltd., was set and fixed such that the direction of the alignment of the nozzles of the line head (main scanning direction) forms an angle of 75.7 degrees with a direction that is orthogonal to the movement direction of the stage (sub-scanning direction), and a solid image was printed by ejection in a line ejection manner at ejection conditions of an ink amount per droplet of 3.5 pL, an ejection frequency of 24 kHz, and a resolution of 1,200 dpi× 600 dpi while moving the recording medium at a constant velocity in the sub-scanning direction, as a result of which a print sample was obtained. The amount of the ink composition applied to the recording medium was 10 g/m$^2$.

Immediately after the printing, the recording medium was dried by heating at 75° C. for 3 seconds using an IR heater. The temperature of a blank area of the recording medium immediately after the drying by heating, as measured by a thermocouple, was 65° C.

Thereafter, the recording medium was cooled for 3 seconds with an air-blowing fan and a cooler.

At the time the temperature of the recording medium after the cooling was 35° C., a powdery starch (CROWN: trade name, manufacture by Toho Seiki Co., Ltd., having a particle diameter of 23 μm) was sprayed onto a face of the recording medium on which the image was formed, using a powder spraying device.

The MTF of the image was 40° C.

The amount of powder applied onto a face of the recording medium on which the inks were applied was 10 particles/mm$^2$.

Example 2

An image was formed by inkjet in the same manner as in Example 1, except that the temperature of the recording medium after the cooling process was adjusted to 25° C.

Example 3

An image was formed in the same manner as in Example 2, except that the powder was replaced with a powder coated with a silicone resin (trade name: NIKKALYCO AS-100, manufactured by Nikka Ltd., having a particle diameter of 20 μm).

Example 4

An image was formed in the same manner as in Example 1, except that the powder was replaced with a silicone resin powder (trade name: KMP-602, manufactured by Shin-Etsu Chemical Co., Ltd., having a particle diameter of 30 μm).

Example 5

An image was formed in the same manner as in Example 1, except that the powder was replaced with a PMMA (poly (methyl methacrylate)) resin powder (trade name: CHEMISNOW MX-800, manufactured by Soken Chemical & Engineering Co., Ltd., having a particle diameter of 8 μm) (cross-linked acrylic powder).

Example 6

An image was formed in the same manner as in Example 1, except that the powder was replaced with a PMMA (poly (methyl methacrylate)) resin powder (trade name: CHEMISNOW MX-3000, manufactured by Soken Chemical & Engineering Co., Ltd., having a particle diameter of 30 μm) (cross-linked acrylic powder).

Example 7

An image was formed in the same manner as in Example 1, except that the content of tripropyleneglycol monomethyl ether in the ink composition was changed from 7% by mass to 5% by mass.

The MFT of the image was 60° C.

Example 8

An image was formed in the same manner as in Example 1, except that the content of tripropyleneglycol monomethyl ether in the ink composition was changed from 7% by mass to 9% by mass.

The MFT of the image was 40° C.

Example 9

An image was formed in the same manner as in Example 1, except that the amount the inks applied to the recording medium was changed to 13 g/m$^2$.

Comparative Example 1

An image was formed in the same manner as in Example 1, except that the powder was not used and cooling was not performed. The temperature of the recording medium when collected and stacked was 55° C.

Comparative Example 2

An image was formed in the same manner as in Example 1, except that cooling was not performed. The temperature of the recording medium just before the powder spraying was 62° C.

Comparative Example 3

An image was formed in the same manner as in Example 1, except that the powder was not used.

Comparative Example 4

An image was formed in the same manner as in Example 1, except that the amount of the inks applied to the recording medium was 5 g/m$^2$.

Experiments

<Image Formation and Evaluation>

The following evaluations were carried out with respect to each of the images obtained in the Examples and Comparative Examples, as described below. The evaluation results are shown in the following Table 1 together with the type of powder, the particle diameter of the powder, the MFT of the image, the temperature of the recording medium when being collected and stacked, the temperature of the recording medium immediately after drying by heating, and the temperature of the recording medium after cooling.

—Evaluation of Blocking—

Two sheets of evaluation samples obtained in the Examples and Comparative Examples were each cut into a size of 4 cm×4 cm. The resultant pieces were adhered to each other such that the recorded face of one piece faced the recorded face of the other piece, and a pressure of 1.0 MPa was applied thereto for 30 seconds, using a press machine. Thereafter, the adhered evaluation sample pieces were separated from each other. The ease of separation and color transfer after separation were visually observed and evaluated in accordance with the following evaluation criteria.

(Evaluation Criteria)

AA: The pieces separate from each other naturally, and color transfer to the other piece is not observed.

A: The pieces adhere to each other, but color transfer between the pieces is not observed.

B: The pieces adhere to each other, and slight color transfer between the pieces is observed.

C: The pieces adhere to each other strongly, and color transfer between the pieces is observed. The extent of the adhesion and the color transfer is practically problematic.

D: The pieces adhere to each other very strongly, and color transfer between the pieces is so severe that the coating layer itself is transferred to the other piece.

—Rubbing Resistance—

Unprinted double-sided TOKUBISHI ART N (trade name) paper manufactured by Mitsubishi Paper Mills Ltd. cut into a size of 10 mm×50 mm was wound around a paperweight (with a weight of 470 g and a size of 15 mm×30 mm×120 mm) (the area of contact between the unprinted recording medium and the evaluation sample would be 150 mm$^2$), and each of the samples obtained in the Examples and Comparative Examples was rubbed with the unprinted paper wound around the paperweight (equivalent to a load of 260 kg/m$^2$) for three reciprocating strokes 5 minutes after printing. After rubbing, the printed surface of the recording medium and the surface of TOKUBISHI ART paper wound around the paperweight were visually observed, and evaluation was conducted according to the evaluation criteria below.

(Evaluation Criteria)

AA: No erasing of the image on the printed surface is visually observed. Color transfer to the TOKUBISHI ART paper wound around the paper weight is not observed visually.

A: No erasing of the image on the printed surface is visually observed. Slight color transfer to the TOKUBISHI ART paper wound around the paper weight is visually observed.

B: Slight erasing of the image on the printed surface is visually observed, and slight color transfer to the TOKUBISHI ART paper is visually observed. The extent of the erasing and the color transfer is practically nonproblematic.

C: Erasing of the image on the printed surface is visually observed. Color transfer to the TOKUBISHI ART paper wound around the paper weight is visually observed. The extent of the erasing and the color transfer is practically problematic.

D: Remarkable erasing of the image on the printed surface is visually observed. Remarkable color transfer to the TOKUBISHI ART paper wound around the paper weight is visually observed. The extent of the erasing and the color transfer is practically problematic.

—Vividness—

The samples obtained in the Examples and the Comparative Examples were visually observed and the color density was evaluated.

A: The color density is sufficient. The quality of the image is practically nonproblematic.

D The color density is insufficient. The quality of the image is practically problematic.

TABLE 1

| | Type of Powder | | Particle Diameter (μm) | MFT of Image (° C.) | Ink Application Amount (g/m$^2$) | Temperature of Recording Medium: Immediately after drying by heating (° C.) | Immediately after cooling (° C.) | At the time of being collected and stacked (° C.) | Effect: Blocking Resistance | Rubbing Resistance | Vivid-ness |
|---|---|---|---|---|---|---|---|---|---|---|---|
| Example 1 | CROWN | Starch | 23 | 50 | 10 | 65 | 35 | 33 | A | A | A |
| Example 2 | CROWN | Starch | 23 | 50 | 10 | 65 | 25 | 25 | AA | AA | A |
| Example 3 | AS-100 | Starch | 20 | 50 | 10 | 65 | 35 | 33 | AA | A | A |
| Example 4 | KMP-602 | Silicone powder | 30 | 50 | 10 | 65 | 35 | 33 | A | A | A |
| Example 5 | MX-800 | Crosslinked acrylic powder | 8 | 50 | 10 | 65 | 35 | 33 | B | A | A |
| Example 6 | MX-3000 | Crosslinked acrylic powder | 30 | 50 | 10 | 65 | 35 | 33 | AA | AA | A |
| Example 7 | CROWN | Starch | 23 | 60 | 10 | 65 | 35 | 33 | A | B | A |
| Example 8 | CROWN | Starch | 23 | 40 | 10 | 65 | 35 | 33 | B | AA | A |
| Example 9 | CROWN | Starch | 23 | 50 | 13 | 65 | 35 | 33 | B | B | A |
| Comparative Example 1 | — | — | — | 50 | 10 | 65 | 62 | 55 | D | D | A |
| Comparative Example 2 | CROWN | Starch | 23 | 50 | 10 | 65 | 62 | 55 | C | D | A |
| Comparative Example 3 | — | — | — | 50 | 10 | 65 | 35 | 33 | C | B | A |
| Comparative Example 4 | CROWN | Starch | 23 | 50 | 5 | 65 | 35 | 33 | A | A | D |

As shown in Table 1, in the images formed in Comparative Examples 1 to 4, at least one of blocking resistance, rubbing resistance or vividness was practically problematic. By contrast, in the images formed in Examples 1 to 9, all of blocking resistance, rubbing resistance and vividness were practically nonproblematic.

What is claimed is:

1. An image forming method comprising:

applying an ink composition including water, a pigment, a water-soluble organic solvent and polymer particles to a recording medium at an application amount of the ink composition of 6 g/m2 or more;

drying by heating the recording medium to which the ink composition has been applied;

cooling the recording medium that has been subjected to the drying by heating to reduce a temperature of the recording medium by at least 5° C. after the drying by heating;

applying a powder to a face of the cooled recording medium to which the ink composition has been applied, wherein a volume average particle diameter of the powder is from 5 μm to 60 μm; and collecting the recording medium, to which the powder has been applied, in a stacking manner.

2. The image forming method according to claim 1, wherein the powder comprises at least one selected from the group consisting of starch that is coated with a silicone resin, silica, an acrylic resin, a styrenic resin and a metal oxide.

3. The image forming method according to claim 1, wherein the powder has been subjected to hydrophobization treatment.

4. The image forming method according to claim 1, wherein an amount of the powder applied to the face of the recording medium to which the ink composition has been applied is from 0.1 particles/mm$^2$ to 50 particles/mm$^2$.

5. The image forming method according to claim 1, wherein a minimum film-forming temperature (MFT) of an image formed by the applying of the ink composition is from 40° C. to 80° C.

6. The image forming method according to claim 1, wherein the cooling of the recording medium is performed using a chiller, an air blowing fan, or a Peltier device.

7. The image forming method according to claim 1, wherein the recording medium is paper having a basis weight of from 127 g/m$^2$ to 420 g/m$^2$.

8. The image forming method according to claim 1, further comprising, after the drying by heating of the recording medium but before the cooling of the recording medium, fixing an image that has been formed on the recording medium by the applying of the ink composition.

9. The image forming method according to claim 1, wherein the collecting of the recording medium in a stacking manner includes cooling the collected and stacked recording medium.

10. The image forming method according to claim 1, further comprising applying a treatment liquid to the recording medium before or after the applying of the ink composition, wherein the treatment liquid includes an aggregating component capable of causing formation of an aggregate by aggregating dispersed particles included in the ink composition.

11. The image forming method according to claim 10, wherein the applying of the treatment liquid is carried out in advance of the applying of the ink composition, and the applying of the ink composition is carried out in such a manner that the applied ink contacts the treatment liquid that has been applied onto the recording medium.

12. The image forming method according to claim 1, wherein the cooling of the recording medium is forced cooling.

13. The image forming method according to claim 1, further comprising cooling the recording medium after the applying of the powder to the face of the cooled recording medium.

14. An image forming apparatus comprising:

an ink application device that applies an ink composition including water, a pigment, a water-soluble organic solvent and polymer particles to a recording medium at an application amount of the ink composition of 6 g/m2 or more;

a heat-drying device that dries by heating the recording medium to which the ink composition has been applied;

a cooling device that cools the recording medium, which has been subjected to the drying by heating, to reduce a temperature of the recording medium by at least 5° C. immediately after the drying by heating;

a powder application device that applies a powder to a face of the cooled recording medium to which the ink composition has been applied, wherein a volume average particle diameter of the powder is from 5 μm to 60 μm; and a stack-collection mechanism that collects the recording medium, to which the powder has been applied, in a stacking manner.

* * * * *